US006791445B2

(12) United States Patent
Shibata et al.

(10) Patent No.: US 6,791,445 B2
(45) Date of Patent: Sep. 14, 2004

(54) COIL-EMBEDDED DUST CORE AND METHOD FOR MANUFACTURING THE SAME

(75) Inventors: Kazuhiko Shibata, Narita (JP); Takashi Nagasaka, Akita-ken (JP); Junetsu Tamura, Akita-ken (JP); Yasuhiko Kitajima, Akita-ken (JP); Hideharu Moro, Funabashi (JP); Tsutomu Chou, Chiba (JP); Tsuneo Suzuki, Chiba (JP)

(73) Assignee: TDK Corporation, Tokyo (JP)

( * ) Notice: Subject to any disclaimer, the term of this patent is extended or adjusted under 35 U.S.C. 154(b) by 58 days.

(21) Appl. No.: 10/078,947

(22) Filed: Feb. 19, 2002

(65) Prior Publication Data

US 2002/0158739 A1 Oct. 31, 2002

(30) Foreign Application Priority Data

Feb. 21, 2001 (JP) ..... 2001-044667
Feb. 21, 2001 (JP) ..... 2001-044815
Sep. 21, 2001 (JP) ..... 2001-290033

(51) Int. Cl.[7] ..... H01F 27/02

(52) U.S. Cl. ..... 336/90; 336/93; 336/96; 336/83

(58) Field of Search ..... 336/90, 92, 96, 336/160, 192, 83, 198, 200, 223, 232

(56) References Cited

U.S. PATENT DOCUMENTS 4,429,314 A * 1/1984 Albright ..... 343/788
5,552,756 A * 9/1996 Ushiro ..... 336/200
6,028,353 A * 2/2000 Nakano et al. ..... 257/701
6,087,922 A * 7/2000 Smith ..... 336/223
6,218,925 B1 * 4/2001 Iwao ..... 336/200
6,278,353 B1 * 8/2001 Downing et al. ..... 336/200
6,362,716 B1 * 3/2002 Anbo et al. ..... 336/200
6,452,473 B1 * 9/2002 Suzuki et al. ..... 336/223
6,587,025 B2 * 7/2003 Smith et al. ..... 336/200

FOREIGN PATENT DOCUMENTS

JP 04-165605 6/1992
JP 04-286305 10/1992
JP 05-291046 11/1993
JP 410027712 A * 1/1998
JP 11-273980 10/1999

* cited by examiner

*Primary Examiner*—Anh Mai
(74) *Attorney, Agent, or Firm*—Hogan & Hartson, LLP

(57) ABSTRACT

A coil-embedded dust core and a method for manufacturing the coil-embedded dust core are provided. The coil-embedded dust core comprises a coil formed from a flat conductor wound in a coil configuration, and a green body consisting of insulating material-coated ferromagnetic metal particles. This results in a coil-embedded dust core more compact in size but with larger inductance. A rectangular wire can be used as the flat conductor. In addition, parts of the coil may function as terminal sections. In this case, the terminal sections of the coil may be formed wider than other part of the coil. The coil-embedded dust core is less prone to joint failures between a coil and terminal sections and to insulation failures of the coil and the terminal section with respect to the magnetic powder. The coil-embedded dust core is more compact while achieving larger inductance.

11 Claims, 13 Drawing Sheets

5A
6
61
10
1
20A
20
71
7
5B

COIL-EMBEDDED DUST CORE AND METHOD FOR MANUFACTURING THE SAME

BACKGROUND OF THE INVENTION

1. Field of the Invention

The present invention relates to a dust core, and more particulary to a coil-embedded dust core, which may be used in inductors having a unitary structure with a magnetic core and in other electronic components. The present invention also relates to a method for manufacturing the coil-embedded dust core.

2. Description of Related Art

In recent years, electric and electronic equipment has become more compact, and dust cores that are compact (low in height) yet able to accommodate large current have come to be in demand.

Materials used for dust cores are ferrite powder and ferromagnetic metal powder, but ferromagnetic metal powder has larger saturation magnetic flux density than ferrite powder and its DC bias characteristics may be maintained even in a strong magnetic field. Consequently, in making a dust core that can accommodate large current, using ferromagnetic metal powder as a material for dust core has become mainstream.

In addition, in order to further the effort to make the core more compact (lower in height), a coil body in which a coil and compacted magnetic powder form a unitary structure has been proposed. In the present specification, an inductor having such a structure may be called a "coil-embedded dust core."

A manufacturing method for a surface-mount type inductor having a structure of a coil-embedded dust core has been proposed in the past. For example, an exterior electrode is connected to an insulation-coated lead wire, and these are enclosed in magnetic power, which is then formed into a magnetic body. In this case, connection parts are inside the magnetic body, which makes them prone to failures while molding. In the present specification, a "connection part" refers to a part where components are electrically connected to each other, and a part where a component is connected to an external electrode is called a "terminal section."

Conventionally, a method of compression-molding flat powder and a coil using a binder is known. For example, the conventional method includes the steps of making a composite material using a Fe—Al—Si metal alloy powder with an aspect ratio of approximately 20 and a silicone resin as an insulating material, and compression-molding the composite material together with a coil. However, no consideration has been given to connection parts between the coil and terminal sections, and joint failures are likely to occur due to the fact that joining is difficult since it takes place between the magnetic body section and an electrode at the interface with the core.

Furthermore, a method of manufacturing an inductor using ferrite as a magnetic material is known. Here again, part of the terminal that forms a connection part with the coil is inside the core, which makes it prone to failures in the connection parts during the process to form a unitary structure.

Also, in one conventional method, an inductor is manufactured by compression-molding a coil and a terminal section while having them vertically interposed in a green body. Failures are likely to occur in the connection parts in this case as well.

As stated above, a coil-embedded dust core has a structure in which large inductance can be obtained in spite of its small size. However, as electric and electronic equipment becomes rapidly more compact, the demand for improved quality of coil-embedded dust core is growing. Specifically, there are demands to prevent joint failures between a coil and terminal sections; to prevent insulation failures of a coil and terminal sections with respect to magnetic powder; to make components even more compact; and to have larger inductance.

The coil-embedded dust core or the inductor proposed in the conventional art can be improved in terms of quality. Namely, the coil-embedded dust core or the inductor in the conventional art has a coil and terminal sections embedded within magnetic powder, which makes it prone to joint failures between the coil and the terminal sections or insulation failures of the coil and the terminal sections with respect to the magnetic powder. When a joint failure or an insulation failure occurs, it is difficult to determine the cause of the failure and in many cases takes a long time, since the coil and the terminal sections form connection parts inside the magnetic powder.

Furthermore, the conventional inductor entails a high possibility for a joint failure to occur in connection parts between a coil and terminal sections after molding, due to the fact that a dust core is made using a coil that already has connection parts formed with terminal sections. When a joint failure occurs in a connection part, determining the cause is difficult and time-consuming.

SUMMARY OF THE INVENTION

In view of the above, it is an object of the present invention to provide a coil-embedded dust core that is not prone to joint failures between a coil and terminal sections or to insulation failures of the coil and terminal section with respect to magnetic powder; that is more compact; and that can provide larger inductance; and to provide a method for manufacturing such a coil-embedded dust core.

The inventors of the present invention have found that by using a coil that is formed from a flat conduction wire, a coil-embedded dust core can be made even more compact while offering larger inductance.

In accordance with one embodiment of the present invention, a coil-embedded dust core comprises a green body consisting of ferromagnetic metal particles coated with an insulating material, and a coil embedded inside the green body wherein the coil is formed from a wound flat conductor coated with an insulation. In one aspect of the present invention, the green body may be a compacted body of magnetic powder including at least ferromagnetic metal particles coated with an insulating material.

In the present invention, the coil may be formed from a rectangular wire wound in a coil. Also, parts of the coil may function as terminal sections. In this case, it would be effective to form the terminal sections to be wider than other parts of the coil. In order to form the wider sections, lead-out end sections of the rectangular wire may be subject to a flattening process. In addition, in the present invention, front and back surfaces of the end sections of the coil may be exposed outside the green body.

In the present invention, the green body may have a structure with front and back surfaces that oppose each other across a predetermined space and side surfaces formed around the front and back surfaces, and each of the end sections of the coil may extend outside the green body along one of the side surfaces.

The present invention further provides a coil-embedded dust core, comprising a green body in a rectangular solid shape having front and back surfaces that oppose each other across a predetermined space and side surfaces formed around the front and back surfaces. There is also a coil having a winding section and end sections pulled out from the winding section, wherein at least the winding section of the coil is placed inside the green body, and end section housing chambers each of which opens to one of the side surfaces of the green body and houses one of the end sections of the coil exposed from the green body.

The end section housing chambers of the coil-embedded dust core according to the present invention may be formed in corner sections of the green body.

Furthermore, the present invention provides a coil-embedded dust core comprising magnetic powder consisting of ferromagnetic metal particles coated with an insulating material, and a coil embedded inside the magnetic powder, wherein the core includes a dust core section molded from the magnetic powder, and the coil is connected to terminal sections (i.e., the coil and the terminal sections form connection parts) outside the dust core section. In order to form the connection parts between the coil and the terminal sections outside the dust core section molded from the magnetic powder, the terminal sections may be extended from side surfaces to a bottom surface of the dust core section. These terminal sections function as surface-mount terminals.

The present invention also provides a coil-embedded dust core comprising a magnetic powder consisting of ferromagnetic metal particles coated with an insulating material, and a coil embedded inside the magnetic powder, wherein the coil is not connected to terminal sections (i.e., the coil and the terminal sections do not form connection parts).

The present invention provides a method for manufacturing a coil-embedded dust core in which a coil is embedded within a green body, the method comprising a preformed body obtaining step, in which a coil wound around with a flat, insulation-coated conductor is placed in a raw material powder whose elements are ferromagnetic metal powder and an insulating material that forms the green body. There is also a compression formation step of compacting the raw material powder.

In the preformed body obtaining step, it is effective to place parts of the coil that make up the terminal sections outside the raw material powder, and to perform, after the compression formation step, a heat treatment step of heat treatmenting the insulating material, a rust-proofing step of forming a rust-proof film on the surface of the terminal sections of the coil, and a sandblasting step of sandblasting the surface of the terminal sections.

Other objects, features and advantages of the invention will become apparent from the following detailed description taken in conjunction with the accompanying drawings.

DESCRIPTION OF PREFERRED EMBODIMENTS

Preferred embodiments of the present invention are described in detail below with reference to the accompanying drawings.

[First Embodiment]

In accordance with a first embodiment of the present invention, a coil-embedded dust core includes a green body and a coil, wherein lead-out end sections of the coil and terminal sections are electrically connected, i.e., the lead-out end sections of the coil form connection parts, outside the green body. In the present embodiment, the green body may preferably be formed from a compression-molded green body of magnetic powder including at least ferromagnetic metal particles coated with an insulating material, which will be described in greater detail below.

Figure 1:
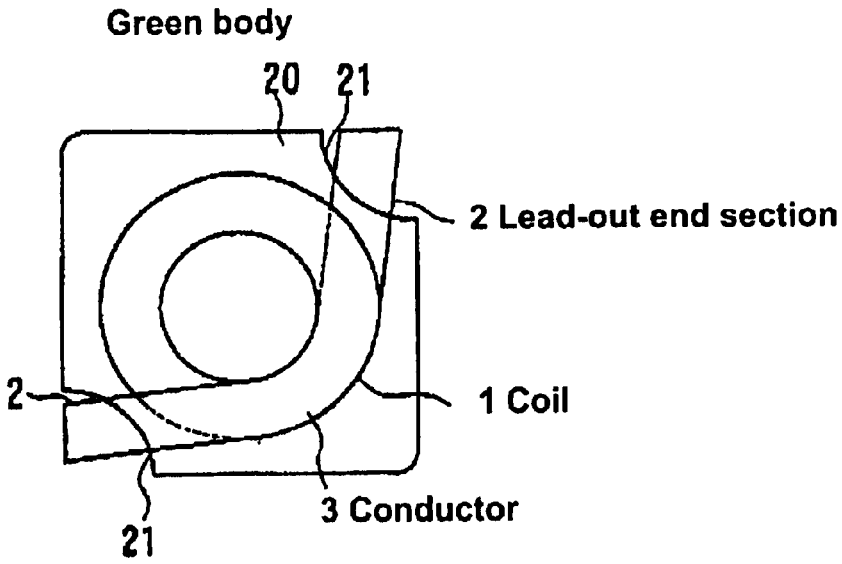
FIG. 1 shows a cross-sectional top view of a coil-embedded dust core in accordance with a first embodiment of the present invention.
Figure 2:
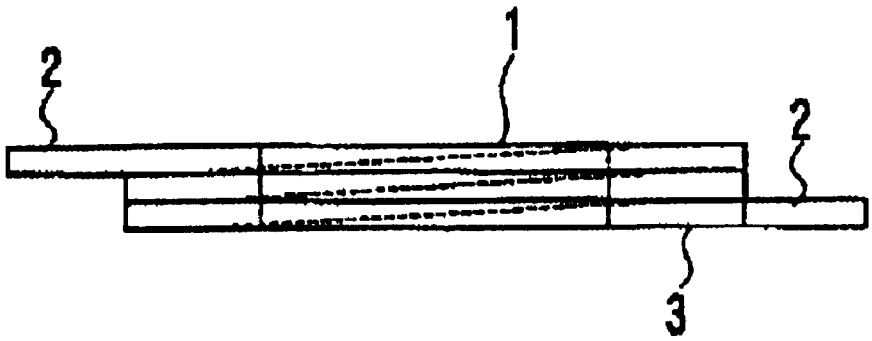
FIG. 2 shows a side view of a coil to be used in the first embodiment.

FIG. 1 is a cross-sectional top view of a coil-embedded dust core according to the first embodiment. FIG. 2 is a side view of a coil 1 used in the first embodiment. As indicated in FIGS. 1 and 2, the coil 1 includes a main body part that is formed from a flat conductor 3 wound in a coil such that the flat conductor 3 forms layers, and lead-out end sections 2, each of which is pulled out from the main body part. A green body 20 covers the coil 1 and its periphery except the lead-out end sections 2 of the coil 1.

First, the structure of the coil 1 is described with reference to FIG. 2.

As shown in FIG. 2, the coil 1 is formed by having the conductor 3, which is insulation-coated, wound three turns in edgewise winding, for example, and is what is called an air-core coil.

The cross-section of the conductor 3 that forms the coil 1 is flat. Some of the possible flat cross-sectional shapes are rectangular, trapezoid or elliptical. The conductor 3 having a rectangular cross-section may be formed from a rectangular wire made of an insulation-coated copper wire. In this case, the rectangular wire has generally flat parallel surfaces defining a width of the generally flat conductor and side surfaces defining a height of the generally flat conductor on both sides of the generally flat parallel surfaces. The generally flat parallel surfaces are wider than the side surfaces, wherein the rectangular wire is wound in a coil in edgewise winding to form layers of windings in the coil such that the generally flat parallel surfaces of the windings are substantially stacked on top of the other, as shown in FIG. 2, for example. When using a rectangular wire as the conductor 3, cross-sectional dimensions may preferably be approximately 0.1–1.0 mm long×0.5–5.0 mm wide.

The insulation coating on the conductor 3 may normally be an enamel coating, and the enamel coating thickness may preferably be about 3 $\mu$m.

When forming the coil 1 by winding a flat conductor 3, the layers of the winding that make up the coil 1 may be extremely close to one another and may be in contact with one another, as shown in FIG. 2. Consequently, capacity per cubic volume may be improved over using a conductor whose cross-section is circular. In addition, the wire occupation rate may be greatly improved over a coil formed by winding a conductor whose number of turns is the same but whose cross-section is circular. As a result, the coil 1 made by winding the flat conductor 3 in a coil is favorable in making a coil-embedded dust core for a large current.

Figure 3:
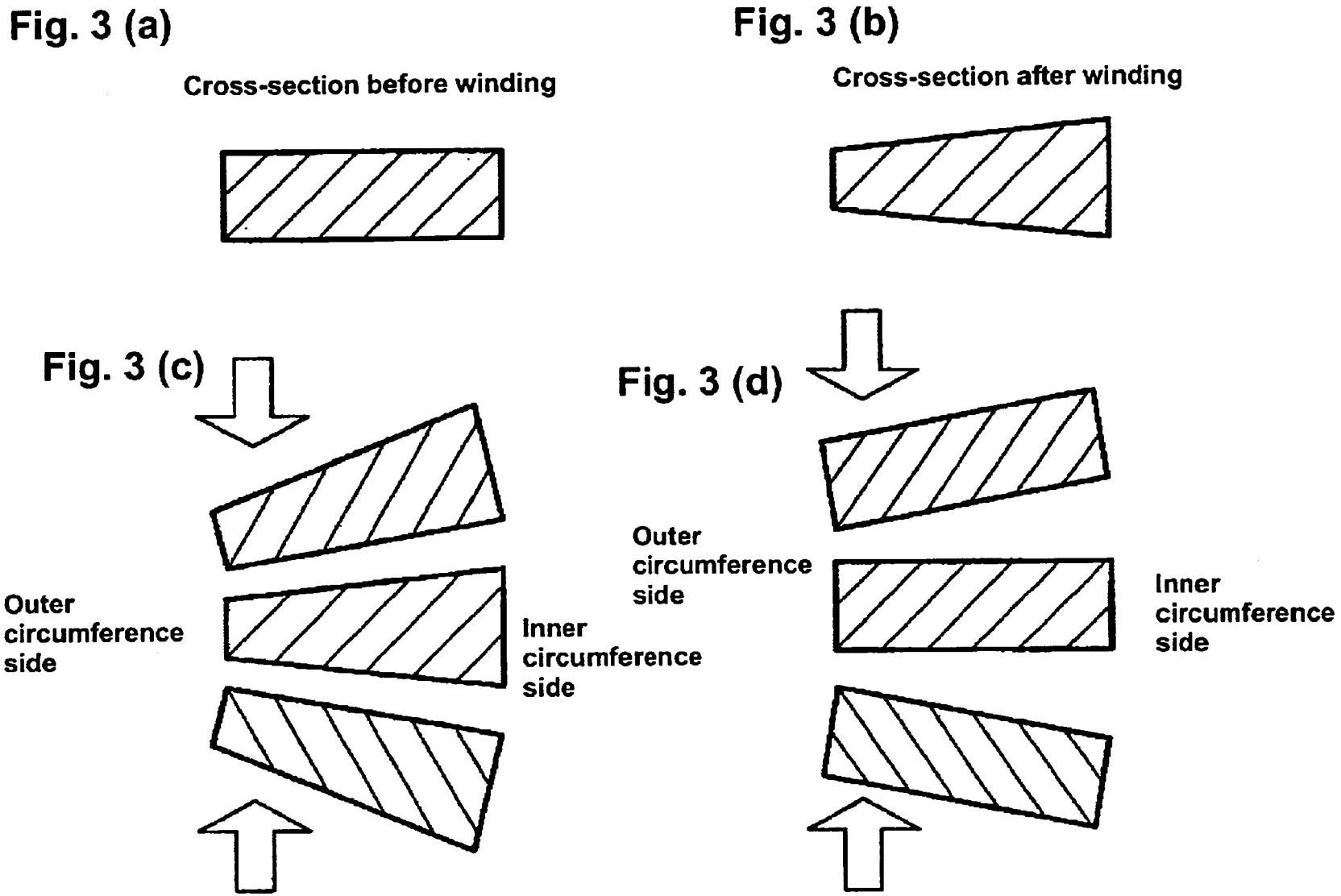
FIGS. 3(*a*)–3(*d*) show cross-sectional views of a conductor before and after winding.

Next, FIG. 3 shows shapes of the cross-section of the flat conductor 3 before winding and after winding.

When a rectangular wire is used as the flat conductor 3, the thickness of the cross-section before winding the conductor 3 is generally uniform, as shown in FIG. 3(*a*). When the conductor 3 is wound from this condition, its thickness on the outer circumference side (on the outer side of the winding) is thinner than its thickness on the inner circumference side (on the inner side of the winding) of the coil 1. Here, as described above, the coil 1 is formed by winding the conductor 3 in a coil a few turns. When the conductor 3 is wound, the windings may eventually come in contact with one another. However, as shown in FIG. 3(*b*), due to the fact that the thickness of the conductor 3 on the outer circumference side of the coil 1 becomes thinner than its thickness on the inner circumference side by having the conductor 3 formed into the coil 1, an air-core coil can be made by winding the conductor 3 while preventing peeling off of or damaging the coating on the conductor 3.

If the coil 1, in which the coating of the conductor 3 has peeled off or suffered damage, were to be embedded within the green body 20, the inductance of the coil-embedded dust core would diminish significantly.

Furthermore, when a press processing is rendered in a state in which the flat conductor 3 is wound in a coil and the thickness of the winding is thinner on the outer circumference side than the thickness on the inner circumference side of the coil 1, as shown in FIG. 3(*c*), the outer circumference side of the coil 1 becomes less prone to damage to the insulation coating. This is at least because the gaps formed between adjacent windings are generally parallel. In contrast, if a press processing is rendered in a state in which the thickness on the outer circumference side and the thickness on the inner circumference side of the coil are generally uniform, as shown in FIG. 3(*d*), the insulation coating on the outer circumference side of the coil is more prone to damage.

In view of the cross-sectional shape of the coil 1 formed after the conductor 3 is wound in a coil, the cross-sectional shape of the conductor 3 may be selected to be trapezoid when appropriate.

The number of turns of the conductor 3 is decided appropriately depending on the inductance required, and it may be approximately one to six turns, and more preferably two to four turns. By winding the flat conductor 3 to make the coil 1, high inductance can be obtained with a small number of turns, which contributes further to making the core more compact (low in height).

Next, the green body 20 is described.

The green body 20 is made by adding an insulating material to ferromagnetic metal powder, mixing them, thereafter drying according to predetermined conditions the ferromagnetic metal powder to which the insulating material has been added, adding a lubricant to the dried magnetic powder, and mixing them.

The ferromagnetic metal powder used in the green body 20 may be at least one of the following: Fe, Fe—Ni—Mo (Supermalloy), Fe—Ni (Permalloy), FeZ—Al—Si (Sendust), Fe—Co, Fe—Si, Fe—P, etc.; and the ferromagnetic metal powder is selected depending on the magnetic properties required. There are no restrictions on the shape of the particles, but a powder with spherical or elliptical particles may be selected to maintain inductance even in a strong magnetic field.

The ferromagnetic metal powder may be obtained by coarsely grinding with a vibrating mill an ingot having a required composition, and milling the coarsely ground powder with a mill, such as a ball mill. Instead of milling an ingot, the powder may be obtained through a gas atomizing method, water atomizing method or rotating disk method.

By adding the insulating material, the ferromagnetic metal powder is insulation-coated. The insulating material is selected depending on the properties of the magnetic core required, and some of the materials that may be used as an insulating material are various organic polymer resins, silicone resin, phenolic resin, epoxy resin, and water glass; moreover, a mixture of one of these resins and inorganic substances may also be used.

The amount of the insulating material to be added varies depending on the properties of the magnetic core required, but approximately 1–10 wt. % may be added. When the amount of the insulating material added exceeds 10 wt. %, permeability falls and the loss tends to be larger. On the other hand, when the amount of the insulating material added is less than 1 wt. %, there is a possibility of insulation failure. A desirable amount of insulating material added is 1.5–5 wt. %.

The amount of the lubricant to be added may be approximately 0.1–1.0 wt. %, the amount of the lubricant to be added may preferably be about 0.2–0.8 wt. %, but the more preferable amount of the lubricant to be added may be about 0.4–0.8 wt. %. When the amount of the lubricant added is less than 0.1 wt. %, removing the die after molding becomes difficult and cracks on the molded product are more likely to occur. On the other hand, when the amount of the lubricant added exceeds 1.0 wt. %, density falls and permeability decreases.

The lubricant should be selected from among, for example, aluminum stearate, barium stearate, magnesium stearate, calcium stearate, zinc stearate and strontium stearate. Using aluminum stearate as the lubricant is desirable, due to the fact that its so-called spring back is small.

In addition, a predetermined amount of a cross-linking agent may be added to the ferromagnetic metal powder. Adding the cross-linking agent does not deteriorate the magnetic properties of the green body 20, and instead increases its strength. The amount of the cross-linking agent to be added may preferably be 10–40 wt. % to the insulating material such as silicone resin. The cross-linking agent may preferably be organic titanium.

As shown in FIG. 1, the green body 20 in the present embodiment has a structure in which concave sections (end section housing chambers) 21 are formed in its diagonally opposite corner sections (corner sections). Each of the lead-out end sections 2 is designed to expose itself in the corresponding concave section 21.

Figure 4:
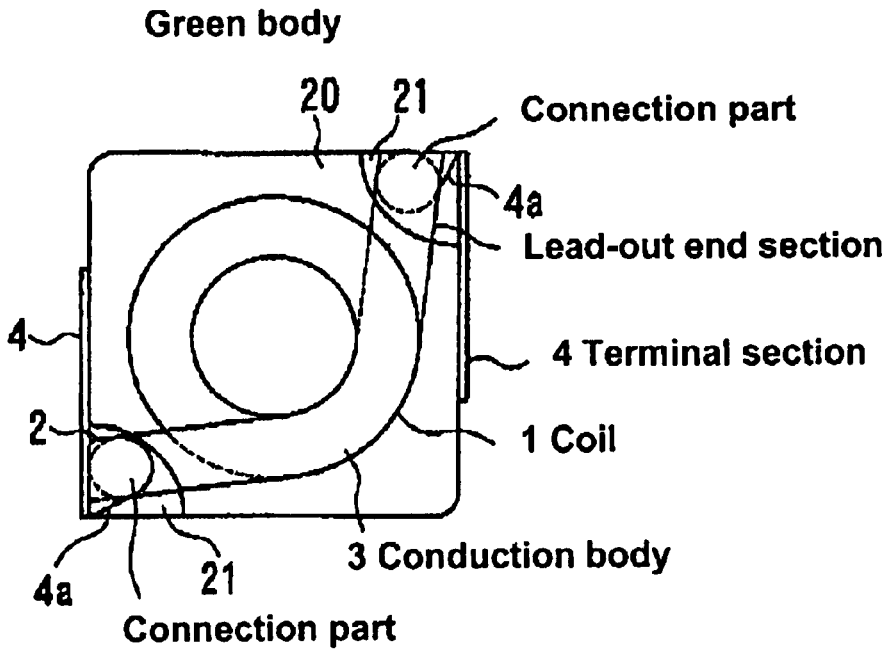
FIG. 4 shows a cross-sectional top view of the coil-embedded dust core in accordance with the first embodiment.
Figure 5:
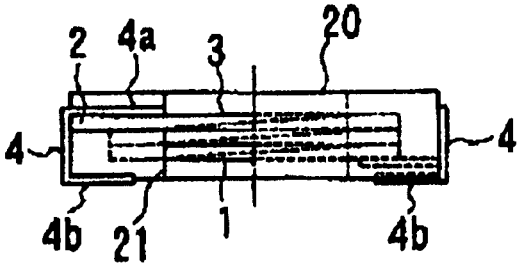
FIG. 5 shows a semi-cross-sectional view as seen from the front of the coil-embedded dust core in accordance with the first embodiment.
Figure 6:
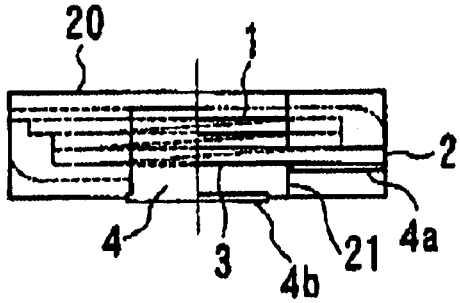
FIG. 6 shows a semi-cross-sectional view as seen from the side of the coil-embedded dust core in accordance with the first embodiment.
Figure 7:
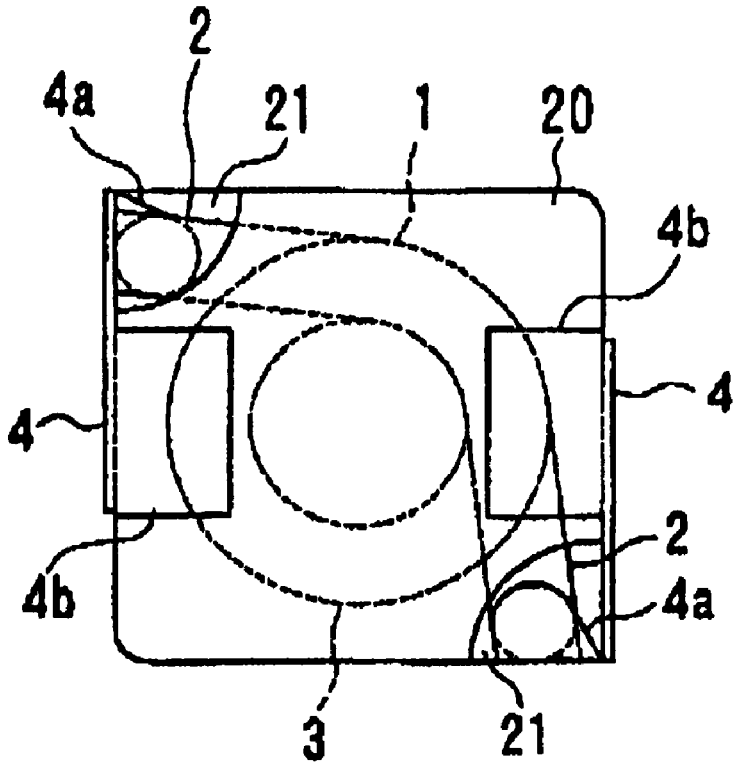
FIG. 7 shows a bottom view of the coil-embedded dust core in accordance with the first embodiment.

The lead-out end sections 2 are the parts that electrically connect, i.e., form connection parts, with terminal sections 4. FIGS. 4 through 7 show a state when the lead-out end sections 2 and the terminal sections 4 form connection parts. FIG. 4 is a cross-sectional top view of the coil-embedded dust core. FIG. 5 is a semi-cross-sectional view of the coil-embedded dust core as seen from the front. FIG. 6 is a semi-cross-sectional view of the coil-embedded dust core as seen from the side. FIG. 7 is a bottom view of the coil-embedded dust core.

As shown in FIGS. 4 through 7, each of the terminal sections 4 is mounted on one side surface of the green body 20. As stated above, the green body 20 in accordance with the present embodiment has a structure in which the concave sections 21 are formed in the diagonally opposing corner sections, and the lead-out end sections 2 may preferably be exposed in the concave sections 21. As a result of this structure, the lead-out end sections 2 and the terminal sections 4 form connection parts without coming into contact with the green body 20, i.e., outside the green body 20. By forming connection parts between the lead-out end sections 2 and the terminal sections 4 outside the green body 20, joint failures between the coil 1 and the terminal sections 4, and insulation failures of the coil 1 and the terminal sections 4 with respect to the magnetic powder, may be prevented.

As shown in FIGS. 4 through 7, each of the terminal sections 4 has a folded section 4*a* and a bottom extension section 4*b*.

Each of the folded sections 4*a* is folded toward the corresponding concave section 21. When forming connection parts between the lead-out end sections 2 and the terminal sections 4, processing such as spot welding or soldering is performed with each of the lead-out end sections 2 overlapping the corresponding folded section 4*a* in order to electrically connect each of the lead-out end section 2 with the corresponding folded section 4*a*. Moreover, by having the bottom extension sections 4*b* extending from the side surfaces to the bottom surface of the green body 20, the terminal sections 4 function as surface-mount terminals.

Next, a method for manufacturing the coil-embedded dust core according to the first embodiment will be described with reference to FIGS. 8 through 11.

Figure 8:
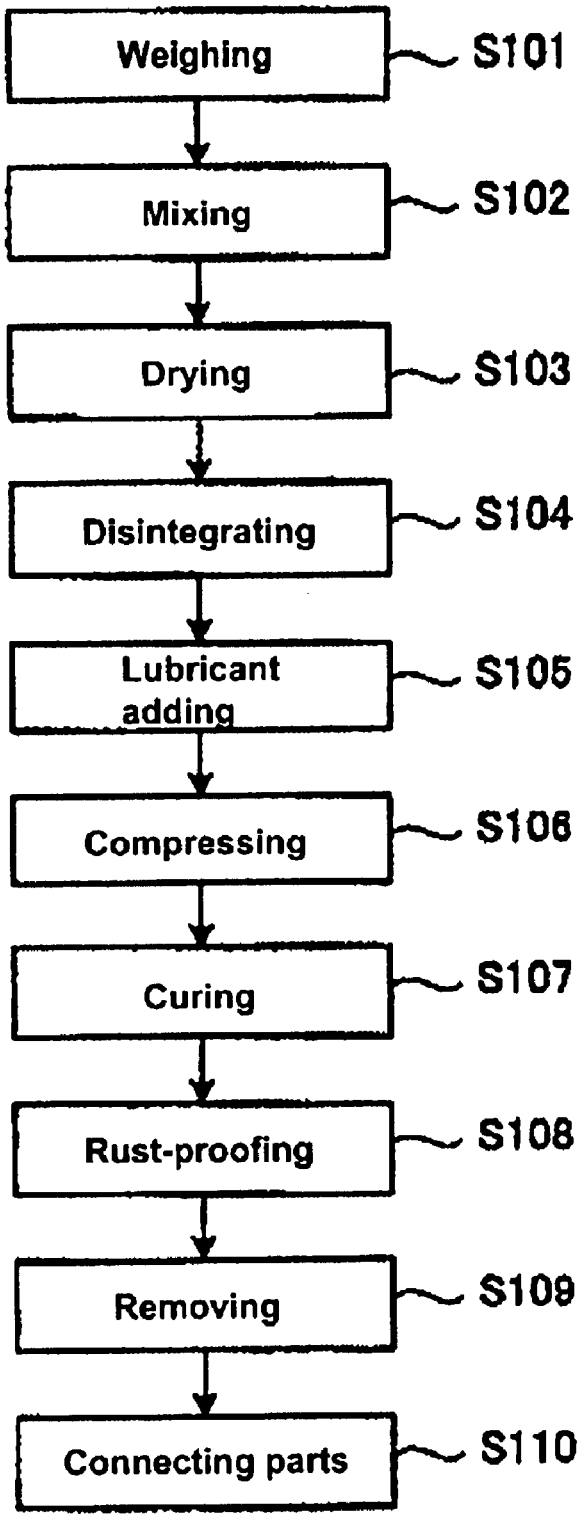
FIG. 8 shows a flow chart of a manufacturing process for the coil-embedded dust in accordance with the first embodiment.

FIG. 8 is a flow chart showing the process for manufacturing the coil-embedded dust core according to the present invention. The coil 1 that is formed from the wound flat conductor 3 may be made in advance.

First, a ferromagnetic metal powder and an insulating material are selected according to the magnetic properties required and they are weighed (step S101). If a cross-linking agent is added, then the cross-linking agent is also weighed in step S101.

After weighing out the ferromagnetic metal powder and the insulating material, they are mixed (step S102). When adding a cross-linking agent, the ferromagnetic metal powder, the insulating material and the cross-linking agent are mixed in step S102. A pressure kneader is used to mix the materials, preferably for 20 to 60 minutes at room temperature. The resulting mixture is dried, preferably for 20 to 60 minutes at approximately 100–300° C. (step S103). Next, the dried mixture is disintegrated to obtain ferromagnetic powder for a dust core (step S104).

In the succeeding step S105, a lubricant is added to the ferromagnetic powder for dust core. After adding the lubricant, the powder and lubricant may preferably be mixed for 10 to 40 minutes.

After adding the lubricant, the compressing step (step S106) is conducted. The compressing step in step S106 is described below with reference to FIGS. 9 through 11.

Figure 9:
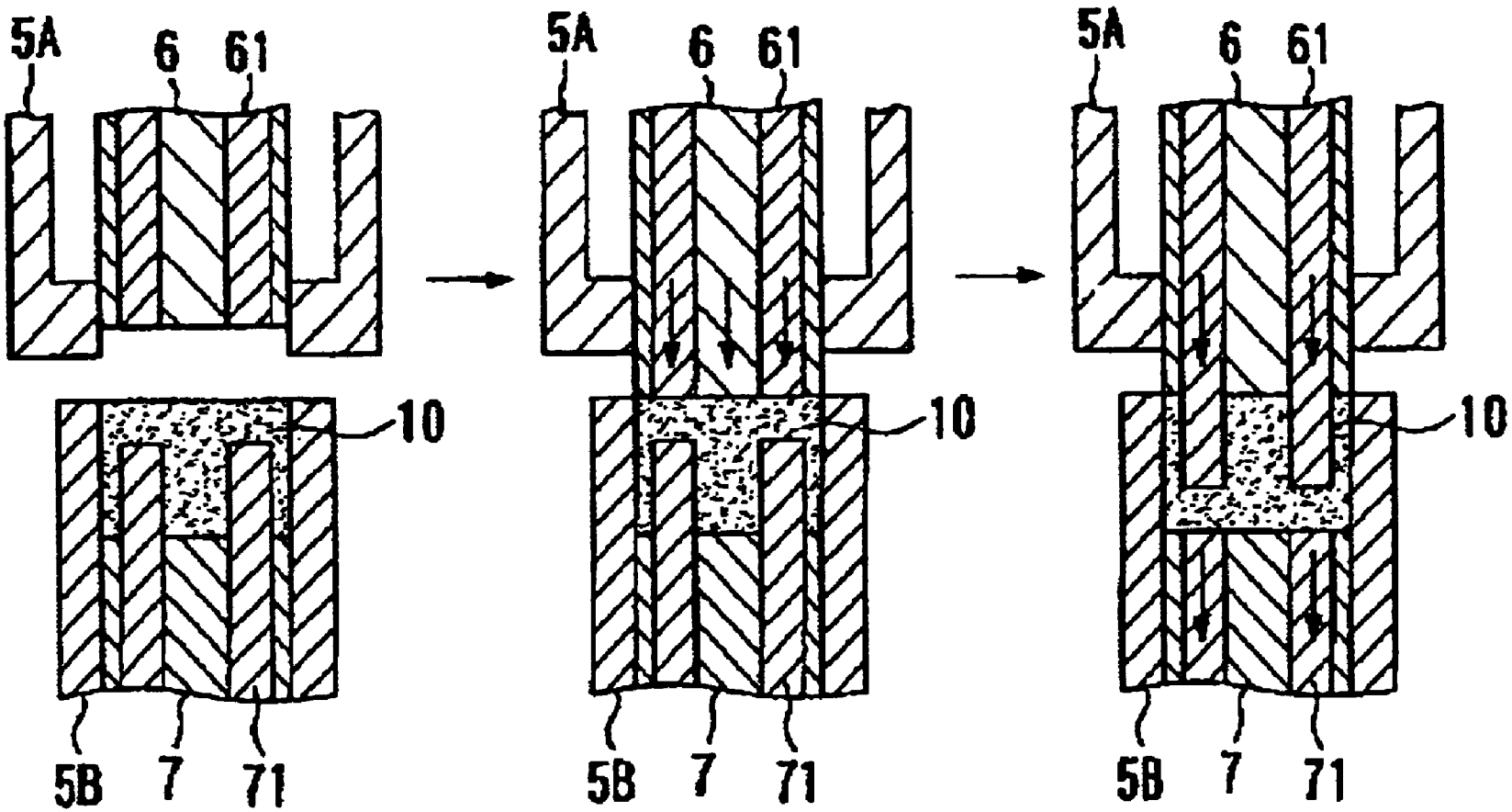
FIGS. 9(A)–9(C) are illustrations of part of the compressing step in step S106 in FIG. 8 (and also in FIG. 15).
Figure 10:
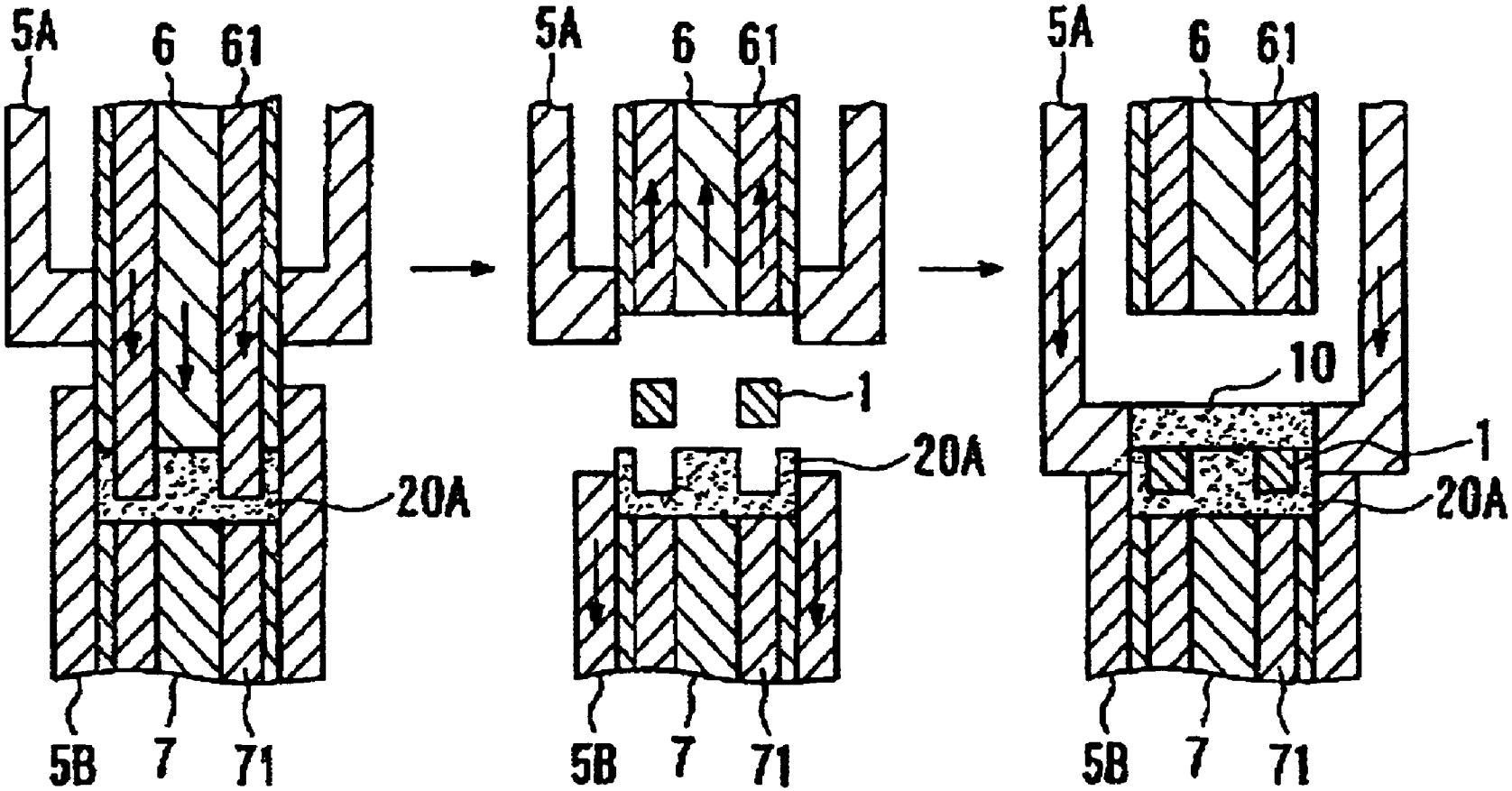
FIGS. 10(A)–10(C) are illustrations of part of the compressing step in step S106.
Figure 11:
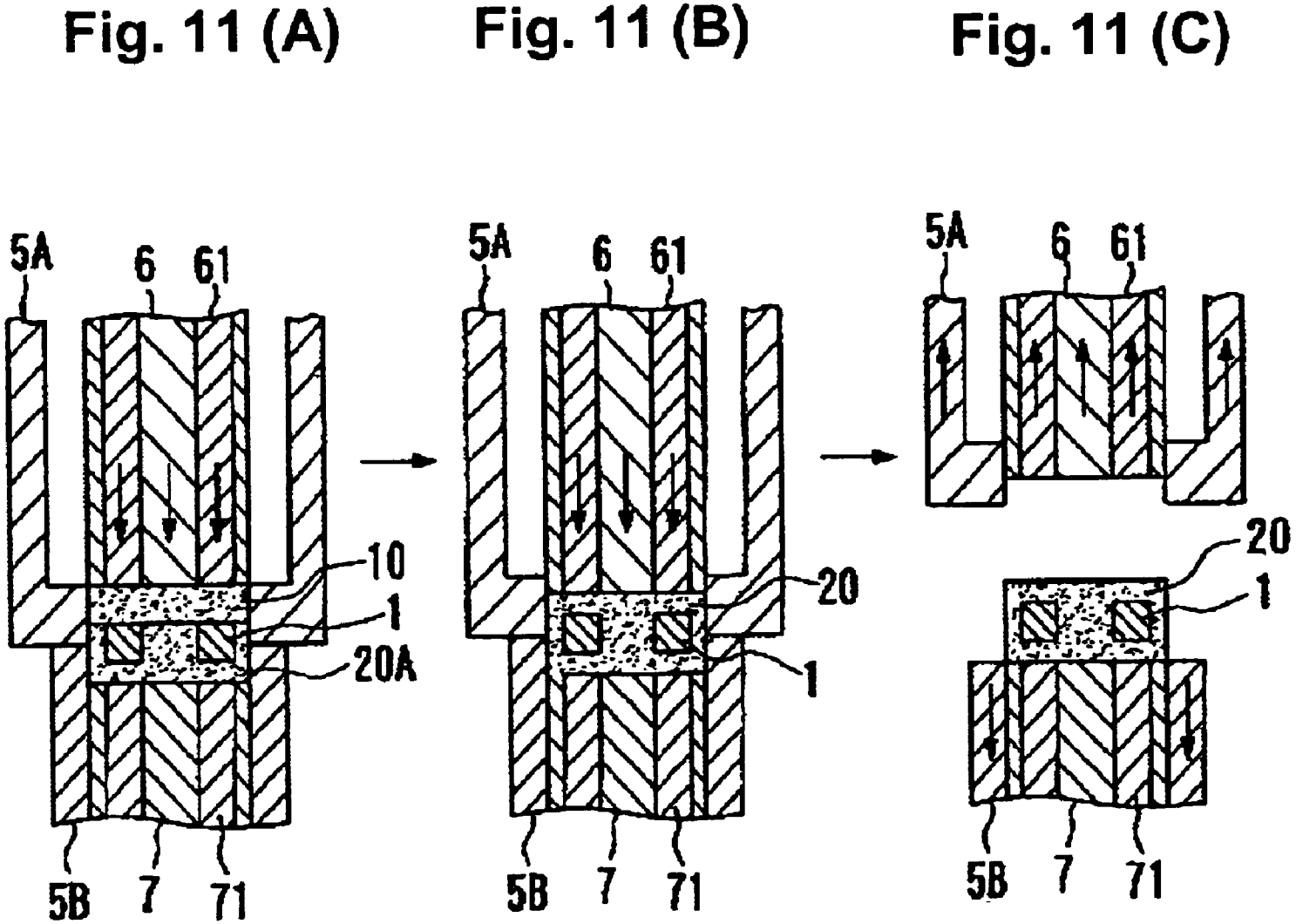
FIGS. 11(A)–11(C) are illustrations of part of the compressing step in step S106.

FIGS. 9 through 11 show the compressing step to compact the mixture of the ferromagnetic powder and the lubricant body prepared in the preceding steps for dust core by die casting using metal mold, i.e., to form a compacting body of the mixture of the ferromagnetic powder and the lubricant. The compacting body may be referred to as a green compact. As shown in FIGS. 9 through 11, an upper die 5A opposes a lower die 5B and a top punch 6 opposes a bottom punch 7. Further, the top punch 6 is equipped with an upper cylindrical divided body 61, and the bottom punch 7 is similarly equipped with a lower cylindrical divided body 71.

In the compressing step, first, the mixed powder 10, which is the ferromagnetic powder for dust core that has been insulation-treated and to which the lubricant has been added and mixed with, is filled into the cavity of the lower die 5B in the state shown in FIG. 9(A), and lower the top punch 6 as shown in FIG. 9(B).

The lower cylindrical divided body 71 is lowered, while at the same time lowering the upper cylindrical divided body 61, as shown in FIG. 9(C). The entire top punch 6 is lowered and a pressure is applied to the mixed powder 10, as shown in FIG. 10(A), such that a bottom section 20A (in a pot shape) of the green body 20 is formed. The desirable pressure application condition is about 100–600 MPa. In this step, the thickness of the bottom section 20A varies depending on the thickness of the green body 20 and on the number of turns on the coil 1, but the thickness of the bottom section 20A may be selected and molded to obtain the desired thickness so that the position of the coil 1 would be in the center of the green body 20.

Next, the coil 1 that is formed from the wound flat conductor 3 is inserted in the groove in the bottom section 20A, while the upper die 5A and the top punch 6 are raised, as shown in FIG. 10(B). Then, the upper die 5A is lowered to the lower die 5B, then the mixed powder 10 is placed into the upper die 5A, as shown in FIG. 10(C). By lowering the top punch 6, pressure molding is conducted as shown in FIGS. 11(A) and 11(B). Next, the upper die 5A and the top punch 6 are raised to obtain a coil-embedded dust core, as shown in FIG. 11(C). Based on the method for manufacturing the coil-embedded dust core according to the present invention, a compact (low in height) coil-embedded dust core of approximately 5–15 mm long×5–15 mm wide×2–5 mm thick is obtained.

The compressing procedure shown in FIGS. 9 through 11 is somewhat simplified for the convenience of description. To form the concave sections 21 of the green body 20, the cavity shape in the upper die 5A and in the lower die 5B may be designed appropriately.

After the compressing step in step S106, the curing step (heat treatment step) (step S107) is conducted.

In the curing step, the coil-embedded dust core obtained in the compressing step (step S106) is kept at temperatures of about 150–300° C. for about 15 to 45 minutes. By doing this, the resin within the coil-embedded dust core hardens.

After the curing step, the rust-proofing step is conducted (step S108). Rust-proofing is done by spray coating epoxy resin, for example, on the coil-embedded dust core. The thickness of the coat resulting from the spray coating may be approximately 15 μm. After rust-proofing, the coil-embedded dust core may preferably be subject to a heat treatment at about 120–200° C. for about 15 to 45 minutes.

Next, each of the lead-out end sections 2 and the corresponding terminal section 4 that are outside the green body 20 of the coil 1 are connected to each other. In other words, a connection part is formed between each of the lead-out end sections 2 and the corresponding terminal section 4 that are outside the green body 20 of the coil 1. In forming the connection parts, first, the insulation coating on the lead-out end sections 2 is removed (step S109). Following this, by using an appropriate method such as spot welding or soldering, a connection part is formed between each of the lead-out end sections 2 and the corresponding terminal section 4 (step S110).

As described above, each of the terminal sections 4 has the bottom extension section 4*b* as shown in FIG. 7. Because the bottom extension sections 4*b* extend from the side surfaces to the bottom surface of the green body 20, the bottom extension sections 4*b* function as surface-mount terminals. The terminal sections 4 may be fixed to the green body 20 by utilizing a structure in which the terminal sections 4 fit on both sides of the green body 20 or a structure in which parts of the terminal sections 4 are inside the green body 20.

The following effects may be obtained according to the first embodiment:

(1) Because the coil 1 is formed from the wound flat conductor 3, large inductance is obtained with a small number of turns.

(2) Because the coil 1 is embedded within the green body 20 without using any spools, there are no gaps between the coil 1 and the magnetic core, and this structure provides such electronic components as a compact (low in height) inductor with large inductance.

(3) Compared with the conventional way of forming connection parts inside the green body, joint and/or insulation failures are reduced.

(4) Due to the fact that the green body 20 is used, the DC bias characteristics that may accommodate large current is superior and the magnetic properties are stable.

It is noted that the number and placement of the terminal sections 4 may vary. In addition, the lead-out end sections 2 of the coil 1 may be subject to a flattening process, the lead-out end sections 2 may be made thin to make forming connection parts with the terminal sections 4 even easier.

[The Second Embodiment]

As a second embodiment of the present invention, an example in which parts of a coil function as terminal sections will be described. Below, components that are different from the first embodiment and peculiar to the second embodiment are described with reference to the drawings. Components identical to the components in the first embodiment are assigned the same numbers.

Figure 12:
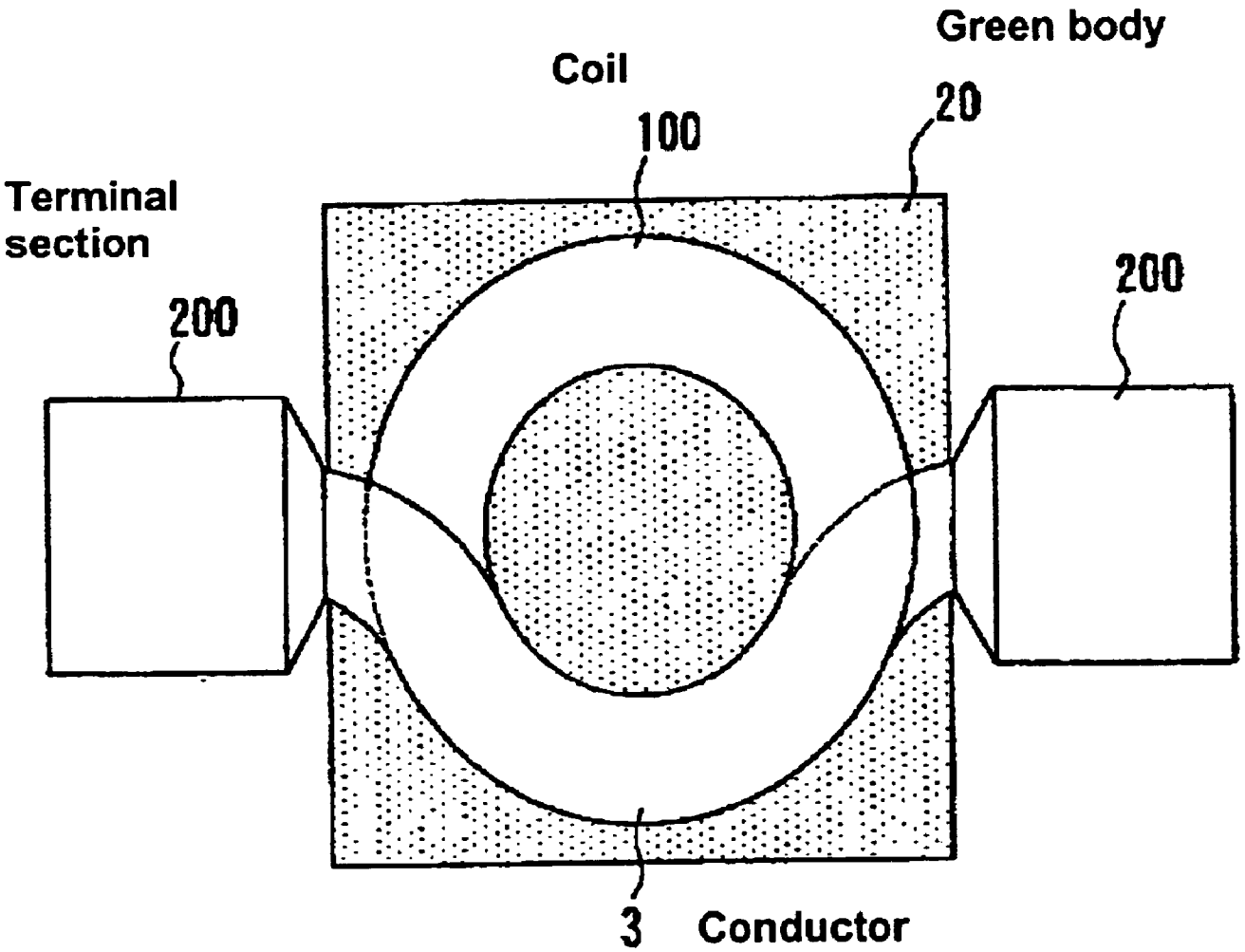
FIG. 12 shows a cross-sectional top view of a coil-embedded dust core in accordance with a second embodiment of the present invention.
Figure 13:
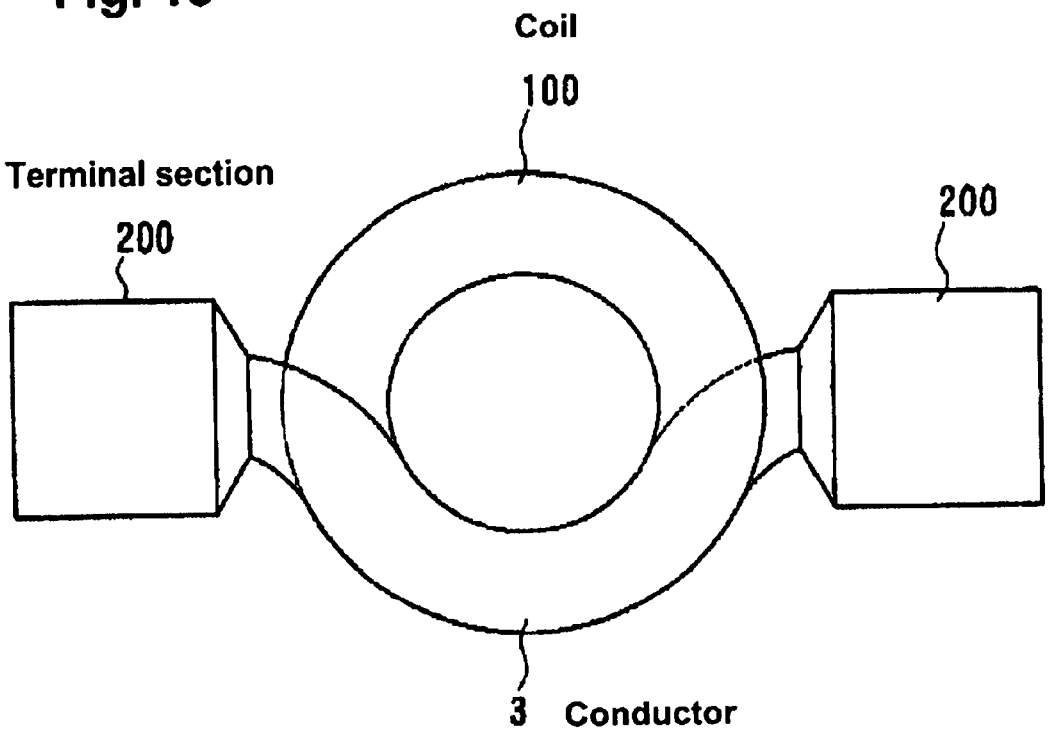
FIG. 13 shows a top view of the coil used in the second embodiment.

FIG. 12 is a cross-sectional top view of a coil-embedded dust core in accordance with the second embodiment. FIG. 13 is a top view of a coil 100 used in the second embodiment, and FIG. 14 is a side view of the coil 100.

Figure 14:
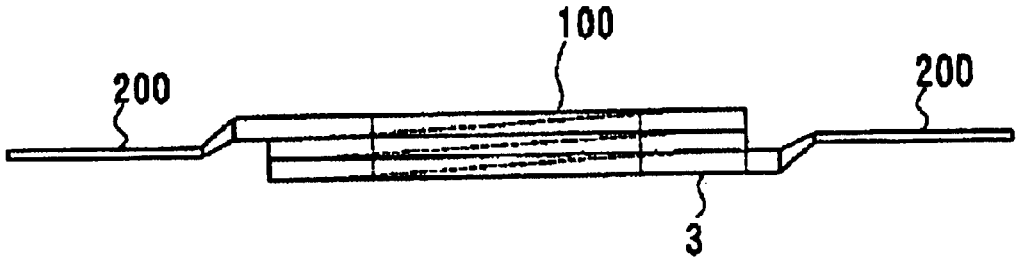
FIG. 14 shows a side view of the coil used in the second embodiment.

As shown in FIGS. 12 through 14, the coil 100 is an air-core coil comprising a main body part, in which conductors 3 are disposed on top of another in layers, and lead-out end sections, each of which is pulled out from the main body part. A green body 20 covers the coil 100 and the periphery of the coil 100 except the lead-out end sections of the coil 100. In the present embodiment, the lead-out end sections of the coil 100 function as terminal sections 200, so that the coil 100 has a so-called unitary structure with terminals. This structure will be described in detail below.

First, the structure of the coil 100 will be explained using FIGS. 13 and 14.

As shown in FIGS. 13 and 14, the coil 100 has the conductor 3 that is wound in a coil three turns in edgewise winding and the lead-out end sections of the conductor 3 are each pulled out and away from the main body part of the coil 100 in opposite directions. In other words, the coil 100 is formed as a unitary structure without any joints.

In order to have the lead-out end sections function as terminal sections 200, the plane area of each of the lead-out end sections is formed to be wider and thinner than the plane area of the conductor 3. This may be achieved through press processing (flattening process) using dies, for example. It is desirable to continue press processing until the thickness of the conductor 3 is about 0.1–0.3 mm. Although the purpose of press processing, as described above, is to form the plane area of the lead-out end sections to be wider and thinner than the plane area of the conductor 3, an additional effect that may be anticipated through press processing is enhanced strength of the terminal sections 200.

A sizing process is performed on the lead-out end sections that have been press processed. The sizing may be performed by using a cutting die, for example.

The terminal sections 200 are not limited to a particular shape, but a rectangle may be preferable in order to accommodate land pattern of the substrate on which the coil-embedded dust core is to be mounted. For instance, when using a coil-embedded dust core in a notebook computer, the shape of the terminal sections 200 may preferably be rectangular with dimensions of approximately 20×30 mm–50×60 mm.

Due to the fact that the conductor 3 is structured so that the lead-out end sections are the terminal sections 200, the coil 100 does not need independent terminal sections. In other words, there are no connection parts between the coil and terminal sections in the coil-embedded dust core according to the second embodiment. By not having any connection parts, the problems that occur in the conventional art should be avoided such as joint failures between the coil and terminal sections or insulation failures of the coil and the terminal section with respect to the magnetic powder.

Next, a method for manufacturing the coil-embedded dust core according to the second embodiment is described below. Steps that are similar to those in the method for manufacturing the coil-embedded dust core according to the first embodiment described above are omitted or simplified in their description, and emphasis is placed on those parts peculiar to the method for manufacturing the coil-embedded dust core according to the second embodiment.

First, as described above, the coil 100 with the wide terminal sections 200 is formed through the processes of winding the conductor 3, forming, press processing the lead-out end sections of the conductor 3, and sizing.

Figure 15:
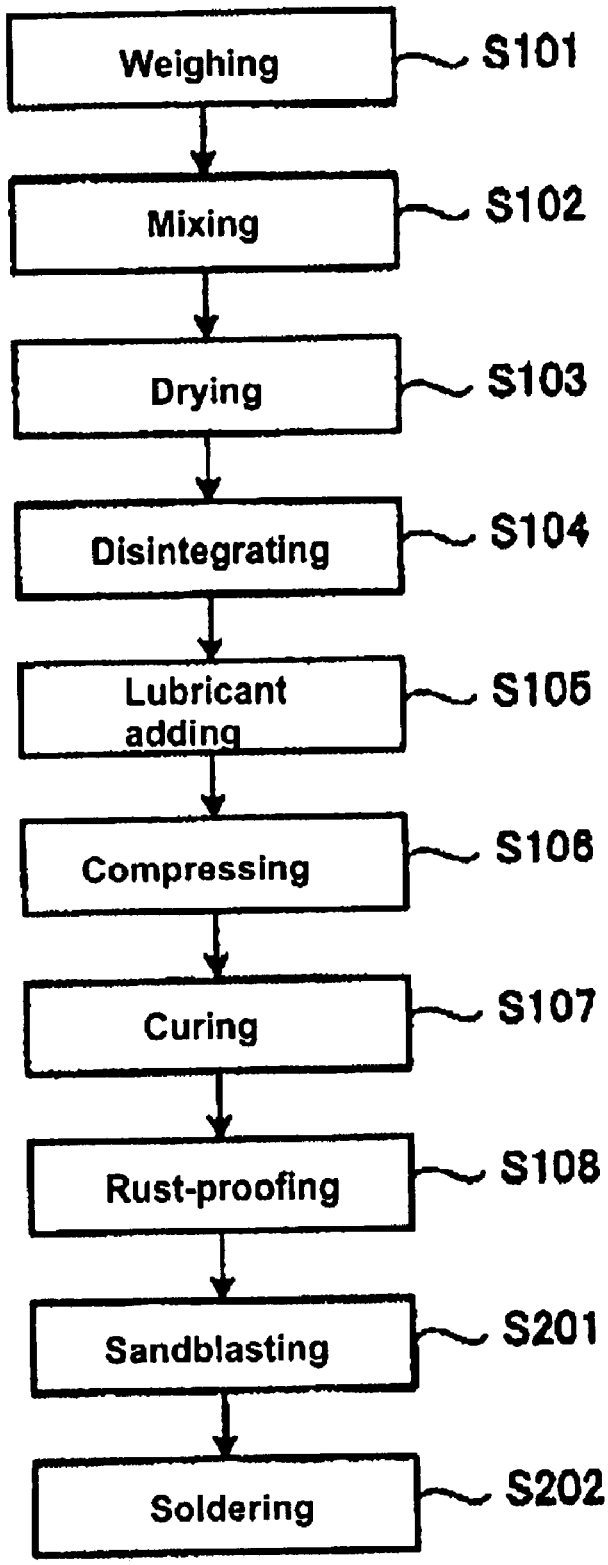
FIG. 15 shows a flow chart of a manufacturing process for the coil-embedded dust core in accordance with the second embodiment.

Next, the coil-embedded dust core according to the second embodiment is made based upon a flow chart shown in FIG. 15. As in the first embodiment, after a weighing step (step S101), a mixing step (step S102), a drying step (step S103), a disintegrating step (step S104) and a lubricant adding and mixing step (step S105), a compressing step (step S106) is conducted.

The compressing step in step S106 may be performed through the process shown in FIGS. 9 through 11 in a manner similar to the one in the first embodiment. In other words, except for the fact that the coil 100 instead of the coil 1 is inserted into a die, i.e., except that the coil 100 on which the wide terminal sections 200 are formed is inserted into a die, a forming process similar to the forming process conducted in the first embodiment may be used.

Alternatively, the compressing step in the step S106 may be conducted through the steps shown in FIGS. 16(A)–16(D).

Figure 16:
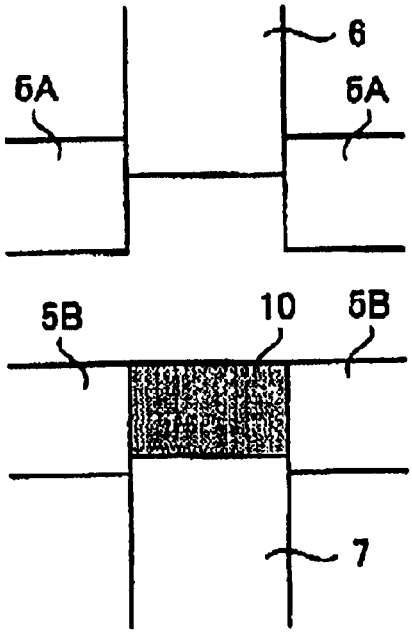
FIGS. 16(A)–16(D) are illustrations of a different compressing step in step S106 in FIG. 8 (also in FIG. 15).
Figure 16:
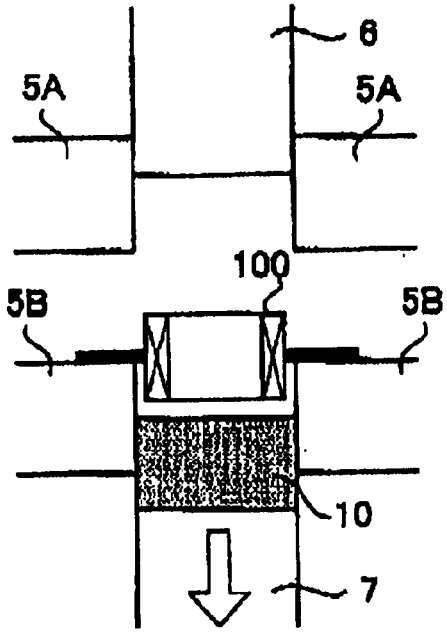
Figure 16:
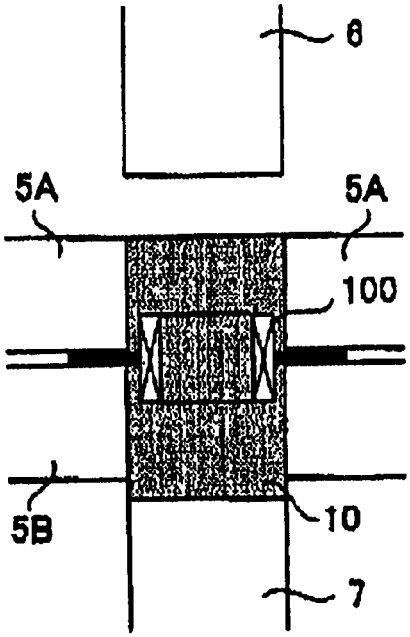
Figure 16:
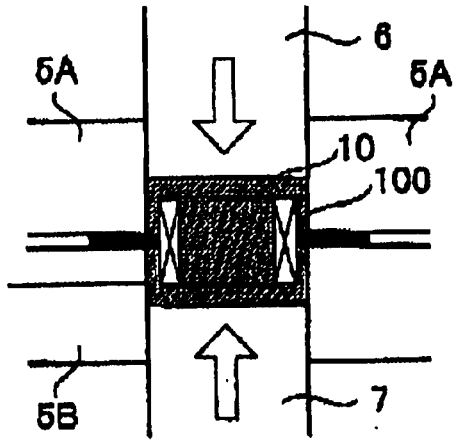

First, in a state shown in FIG. 16(A), the mixed powder 10, in which the lubricant has been mixed with the insulation-coated ferromagnetic powder for a dust core is filled into the cavity of a lower die 5B. Next, the bottom punch 7 is lowered, and the coil 100 on which the wide terminal sections 200 have been formed is inserted into the lower die 5B, as shown in FIG. 16(B). An upper die 5A is lowered onto the lower die 5B, and the mixed powder 10 is placed into the upper die 5A, as shown in FIG. 16(C). Next, the top punch 6 is lowered, the bottom punch 7 is raised and a pressure is applied, as shown in FIG. 16(D). As a result, a coil-embedded dust core in which the coil 100 is embedded is obtained. The desirable pressure application condition may be about 100–600 MPa. It is also desirable to determine the amount of the mixed powder 10 to be filled into the lower die 5B and the amount of the mixed powder 10 to be filled into the upper die 5A, so that the position of the coil 100 would be in the center of the green body 20.

After the compressing step in step S106, a curing step (step S107) and a rust-proofing step (step S108) are conducted, and then a sandblasting step (step S201) is conducted. The sandblasting step in step S201 is a distinctive step in making the coil-embedded dust core according to the second embodiment.

As stated above, parts of the coil 100 are the terminal sections 200 in the coil-embedded dust core according to the second embodiment. However, the conductor 3 used therein has an insulation coating, such as an enamel coating, formed on its surface to begin with. It is observed by the inventors that a copper oxide film forms directly underneath the insulation film in the curing step in step S107. Further, a paint film forms on top of the insulation film through rust-proofing (step S108). These films formed on the terminal sections 200 are removed in the sandblasting step (step S201).

One way to remove the three layers of films formed on the surface of the coil 100 is to corrode them with chemicals. However, because different chemicals are required to remove different films, several treatments must be rendered in order to remove the three layers of films. In addition, the chemical corrosion method requires heating the chemicals, which entails a risk of alkaline particles or acidic particles attaching to the paint film or the insulation film of the terminal sections 200 when the chemicals are heated. Such attachments would result in progressive corrosion of the paint film or the insulation film over a long period of time and are likely to cause diminished rust-proofing efficiency or a short-circuit between the layers of the coil. To avoid such risks, there is a mechanical removable method using tools; however, tools that may damage the copper part of the conductor 3 cannot be used, since the thickness of the terminal sections 200 of the coil-embedded dust core according to the present embodiment is 5 mm or less (approximately 0.1–0.3 mm). Consequently, in the present embodiment, a sandblasting method is used to remove the three layers of films.

The removal effect through sandblasting varies by the type of abrasive used, the particle size of the abrasive and spray conditions. Next, a description is made as to how the abrasive is selected and what abrasive should be sprayed under what conditions in removing all at once a plurality of films formed on the terminal sections 200.

(Types of Abrasive and the Grain Diameter of Abrasive)

Abrasives with large friability are desirable. Here, large friability is defined using as a reference the friability of alumina as an abrasive, so that abrasives whose friability is larger than the friability of alumina are considered to have large friability. Conversely, abrasives whose friability is smaller than the friability of alumina are considered to have small friability. Some of the abrasives with large friability are silicon carbide, diamond and silicon nitride, but it may be desirable to use silicon carbide in terms of cost. On the other hand, abrasives with small friability are resin and calcium carbonate, but removing the films using these would take time and cause grains to hit parts where the films have already been removed from, and consequently cause the copper part of the conductor 3 to be elongated, which would result in warping.

Further, desirable abrasives would not only have large friability but also have a small particle size. By using an abrasive with large friability and a small particle size, the impact caused by each grain may be reduced. As a result of this, compared to using an abrasive with a large particle size, the chosen abrasive would hit the terminal sections 200 uniformly to remove the films without causing warping. The range of particle size in abrasives may preferably be between 800# and 2000#.

(Spray Conditions of Abrasive)

Spray conditions of the abrasive include spray pressure, spray time and spray angle.

The spray pressure may be in the range of 0.1–1 MPa, and preferably the spray pressure may be 0.2–0.8 MPa, and more preferably 0.2–0.6 MPa.

The spray time should be less than 20 seconds, preferably 1–18 seconds, and more preferably 3–15 seconds. Even when using a desirable abrasive, i.e. an abrasive with large friability and small particle size, a spray time of 20 seconds or more may cause warping in the terminal sections 200.

The desirable spray angle is about 10 degrees–60 degrees.

When the terminal sections 200 are to be surface-mount terminal sections, the terminal sections 200 are soldered (step S202). Thereafter, it would be convenient to bend the terminal sections 200, which have become wide through a flattening process, as necessary when mounting the coil-embedded dust core on a substrate.

The following effects may be gained from the coil-embedded dust core according to the second embodiment:

(1) By using the coil 100 around which the flat conductor 3 is wound, large inductance may be obtained with a small number of turns.

(2) Due to the fact that parts of the coil 100 are the terminal sections 200, there is no need to form connection parts between the coil 100 and the terminal sections. Consequently, joint failures and insulation failures caused by connection parts may be eliminated.

(3) Due to the fact that parts of the coil 100 are the terminal sections, there is no need to prepare terminal sections separately. Consequently, the number of components may be reduced.

(4) The coil 100 is embedded within the green body 20 without using any spools. Consequently, there are no gaps between the coil 100 and the magnetic core, and this leads to such electronic components as a compact (low in height) inductor with large inductance.

(5) Due to the fact that the green body 20 is used, the DC bias characteristics that may accommodate large current is superior and the magnetic properties are stable.

Examples of the coil-embedded dust core according to the present invention will now be described in detail using the embodiments. The coil-embedded dust core and its manufacturing method according to the first embodiment of the present invention will be described as example 1. The coil-embedded dust core and its manufacture method according to the second embodiment of the present invention will be described as example 2.

EXAMPLE 1

A sample of the coil-embedded dust core was made according to the following procedure:

The following were prepared:

Magnetic powder: Permalloy powder manufactured through atomizing method (45% Ni—Fe; average particle size 25 μm)

Insulating material: silicone resin (SR2414LV by Toray Dow Corning Silicone Co., Ltd.)

Lubricant: aluminum stearate (SA-1000 by Sakai Chemical Industry)

Next, 2.4 wt. % of the insulating material was added to the magnetic powder, and these were mixed for 30 minutes at room temperature using a pressure kneader. Following this, the mixture was exposed to air and dried for 30 minutes at 150° C. 0.4 wt. % of the lubricant was added to the dried magnetic powder and mixed for 15 minutes in a V mixer.

Next, a coil-embedded dust core was molded by following the molding process shown in FIGS. 9 through 11. The pressure applied in the first compress molding in FIG. 10(A) was 140 MPa, and the pressure applied in the second compress molding in FIG. 11(B) was 440 MPa. As shown in FIG. 2, the coil 1 was made by using the conductor 3 whose cross-section was rectangular (0.45 mm×2.5 mm) and which was wound 2.8 turns in edgewise winding. The conductor 3 was an insulation-coated copper wire.

After compression molding, the coil-embedded dust core was heat treated for 15 minutes at 200° C. in order to harden the silicone resin, a thermosetting resin used as the insulating material. Following this, epoxy resin was spray coated on the coil-embedded dust core and an epoxy coat with thickness of 15 μm was formed. Next, the insulating film formed on the lead-out end sections 2 was removed.

Then, the lead-out end sections 2 of the coil 1 were connected with the terminal sections 4 to form connection parts at two places outside the green body 20, as shown in FIGS. 4 through 7.

As a result, joint and/or insulation failures were reduced significantly compared to conventional structures where the connection parts are inside the green body 20.

By providing the structure described above in example 1, a coil-embedded dust core that is compact (low in height), has large inductance and has no joint failures or insulation failures, was obtained.

EXAMPLE 2

Samples of the coil-embedded dust core were made according to the following procedure:

The following were prepared:

Magnetic powder: Permalloy powder manufactured through atomizing method (45% Ni—Fe; average particle diameter 25 μm)

Insulating material: silicone resin (SR2414LV by Toray Dow Corning Silicone Co., Ltd.)

Cross-linking agent: organic titanate (TBT B-4 by Nisso Co. Ltd.)

Lubricant: aluminum stearate (SA-1000 by Sakai Chemical Industry)

Next, 2.4 wt. % of the insulating material and 0.8 wt. % of the cross-linking agent were added to the magnetic powder, and these were mixed for 30 minutes at room temperature using a pressure kneader. Following this, the mixture was exposed to air and dried for 30 minutes at 150° C. 0.4 wt. % of the lubricant was added to the dried magnetic powder and mixed for 15 minutes in a V mixer.

Next, a coil-embedded dust core was made by following the procedure shown in FIGS. 16(A) through (D). The pressure applied in the step illustrated in FIG. 16(D) was 140 MPa. As shown in FIGS. 13 and 14, the coil 100 was made by using the conductor 3 whose cross-section was rectangular (0.5 mm×0.8 mm) and which was wound 1.5 turns in edgewise winding. The conductor 3 was an insulation-coated copper wire. After compression molding, the coil-embedded dust core was heat treated for 30 minutes at 285° C. in order to harden the silicone resin, a thermosetting resin used as the insulating material. Following this, epoxy resin was spray coated on the terminal sections 200 of the coil 100 and an epoxy coat with thickness of 15 μm was formed on the terminal sections 200.

Next, the three layers of films formed on the terminal sections 200 of the coil 100 were removed by sandblasting, and the removal state and whether warping has resulted were observed. The sandblasting conditions, removal state, and whether warping resulted are shown in table 1. Also indicated in table 1 are the abrasives used, which were silicon carbide (containing iron powder), resin and alumina. The respective particle sizes are indicated in Table 1.

TABLE 1

| | | | Spray Conditions | | | | |
|---|---|---|---|---|---|---|---|
| No. | Abrasive | Particle Size | Pressure (Mpa) | Time (sec) | Warping | Removal State | Product Name |
| Sample 1 | silicon carbide (containing iron powder) | 800 # | 0.4 | 10 | no | good | GC by Fuji Seisakusho K.K. |
| Sample 2 | silicon carbide (containing iron powder) | 1500 # | 0.4 | 3 | no | good | GC by Fuji Seisakusho K.K. |
| Sample 3 | silicon carbide (containing iron powder) | 2000 # | 0.4 | 3 | no | good | GC by Fuji Seisakusho K.K. |

TABLE 1-continued

| No. | Abrasive | Particle Size | Spray Conditions Pressure (Mpa) | Spray Conditions Time (sec) | Warping | Removal State | Product Name |
|---|---|---|---|---|---|---|---|
| Sample 4 | resin | 60 # | 0.3 | 10 | | poor | MG-3 by Rich Hills Co., Ltd. |
| Sample 5 | resin | 60 # | 0.4 | 20 | yes | good | MG-3 by Rich Hills Co., Ltd. |
| Sample 6 | alumina | 400 # | 0.2 | 10 | yes | good | Fuji Rundum WA by Fuji Seisakusho K.K. |
| Sample 7 | alumina | 800 # | 0.4 | 15 | yes | good | Fuji Rundum WA by Fuji Seisakusho, K.K. |
| Sample 8 | silicon carbide (containing iron powder) | 400 # | 0.2 | 10 | yes | good | GC by Fuji Seisakusho K.K. |

As shown in Table 1, in samples 1 through 3 in which silicon carbide (containing iron powder) was used as the abrasive, the three layers of films on the terminal sections 200 were removed without any warping.

When sample 1 and sample 2 are compared, it is notable that sample 2 (particle size: 1500#) whose particle size is smaller than that of sample 1 (particle size: 800#) had no warping in spite of a short spray time of merely three seconds and had a good removal state.

Warping resulted in sample 8 (particle size: 400#) in spite of the fact that silicon carbide and iron powder were used as the abrasive.

Consequently, it can be said that in addition to the type of abrasive used, the particle size and sandblast spray conditions are also important elements in film removal. Based upon the fact that a good removal state and no warping resulted in sample 1 (particle size: 800#), sample 2 (particle size: 1500#) and sample 3 (particle size: 2000#), it can be speculated that when using silicon carbide and iron powder as an abrasive it would be desirable to use a particle size which is smaller than 400#.

Sample 4 in which a resin was used as the abrasive (sandblast spray conditions were pressure 0.3 MPa, spray time 10 seconds) had a poor removal state. Sample 5 in which resin was used as the abrasive (sandblast spray conditions were pressure 0.4 MPa, spray time 20 seconds) had a good removal state but had warping. Since sample 4 and sample 5 have the same particle size of 60#, it is observed that warping is more likely to occur as the sandblast spray pressure and spray time increase.

Sample 6 and sample 7, in which alumina was used as the abrasive, both had a good removal state but both had warping.

Based on the above results, it was found that the three layers of films on the terminal sections 200 may be removed without any warping by using silicon carbide (containing iron powder) as the abrasive and by setting the sandblast spray conditions within appropriate ranges. Furthermore, in sample 2 and sample 3, good removal state resulted without any warping in spite of the fact that the sandblast spray time was only three seconds. Consequently, it is assumed that the sandblasting time may preferably be approximately 3–15 seconds.

By employing sandblasting as a film removal method as suggested by the present invention, the oxide film, the insulation film and the paint film may be removed all at once without causing any deformation or major damage to the copper part of the terminal sections 200. This makes soldering easy, which leads to the creation of high-performance coil-embedded dust cores.

After soldering the terminal sections 200 of the coil 100, it would be convenient to bend each of the terminal sections 200 so that it would come in contact with one of the side surfaces of the green body 20 when mounting the coil-embedded dust core on a substrate.

As described above, according to the present invention, a coil-embedded dust core can be made even more compact and with larger inductance.

While the description above refers to particular embodiments of the present invention, it will be understood that many modifications may be made without departing from the spirit thereof The accompanying claims are intended to cover such modifications.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A coil-embedded dust core, comprising:

a green body formed from ferromagnetic metal particles coated with an insulating material; and a coil embedded inside the green body, the coil being formed from a flat, insulation-coated conductor wound in a coil.

2. A coil-embedded dust core according to claim 1, wherein the coil is formed from a rectangular wire wound in a coil.

3. A coil-embedded dust core according to claim 1 or claim 2, wherein the coil has parts that function as terminal sections.

4. A coil-embedded dust core according to claim 1, wherein the flat conductor includes a end section having two opposed surface that are exposed outside the green body.

5. A coil-embedded dust core according to claim 3, wherein the terminal sections are wider than other parts of the coil.

6. A coil-embedded dust core according to claim 2, wherein lead-out end sections of the rectangular wire are formed into wide terminal sections by a flattening process.

7. A coil-embedded dust core according to claim 1, wherein the green body has front and back surfaces that oppose each other across a predetermined space and side surfaces formed around the front and back surfaces, and an end section of the coil extends outside the green body along one of the side surfaces.

8. A coil-embedded dust core according to claim 1, wherein the rectangular wire has flat parallel surfaces defining a width of the rectangular wire and side surfaces defining a height of the rectangular wire on both sides of the flat parallel surfaces, the flat parallel surfaces being wider than the side surfaces, wherein the rectangular wire is wound in a coil in edgewise winding to form layers of windings in the coil such that the flat parallel surfaces of the windings are substantially stacked on top of the other.

9. A coil-embedded dust core according to claim 8, wherein the coil defines an outer circumference side and an inner circumference side of the flat parallel surfaces, and a thickness of the flat conductor on the outer circumference side is smaller than a thickness thereof on the inner circumference side.

10. A coil-embedded dust core, comprising:

a dust core section molded with magnetic powder formed from ferromagnetic metal particles coated with an insulating material and a coil embedded inside the magnetic powder; and terminal sections outside the dust core section, wherein the coil and the terminal sections are not connected to one another.

11. A coil-embedded dust core comprising:

a green body formed from ferromagnetic metal particles coated with an insulating material; and a coil embedded inside the green body, the coil being formed from a flat, insulation-coated conductor, the flat conductor being wound in edgewise winding in the coil such that the flat conductors are stacked on top of one another with substantially no spacing between adjacent flat conductors.

* * * * *